US005702010A

United States Patent [19]

Liang

[11] Patent Number: 5,702,010

[45] Date of Patent: Dec. 30, 1997

[54] RETRACTABLE LAUNDRY SUSPENSION ROD

[76] Inventor: Shan-Kuai Liang, Suite 5, 6F, No. 52, Chung Chin First Street, Ren Der Shiang, Tainan Hsien, Taiwan

[21] Appl. No.: 566,537

[22] Filed: Dec. 4, 1995

[51] Int. Cl.[6] ..... D06F 57/00; A47G 25/00

[52] U.S. Cl. ..... 211/105.1; 211/105.3; 211/123; 211/206

[58] Field of Search ..... 211/105.1, 105.3, 211/105.5, 105.6, 123; 248/340; 223/85; 241/206

[56] References Cited

U.S. PATENT DOCUMENTS

| | | | |
|---|---|---|---|
| 1,037,846 | 9/1912 | Anderson | 211/105.3 |
| 1,653,742 | 12/1927 | Sparrow | 211/123 X |
| 2,293,168 | 8/1942 | Pirone | 211/123 |
| 2,382,249 | 8/1945 | Megar | 211/123 X |
| 2,594,605 | 4/1952 | Zoppelt | 211/123 |
| 3,001,754 | 9/1961 | Fowler | 211/105.3 X |
| 3,428,282 | 2/1969 | Pernice | 211/123 X |
| 4,494,896 | 1/1985 | DiFranco | 211/105.3 X |
| 4,895,471 | 1/1990 | Geltz et al. | 211/105.3 X |
| 5,104,269 | 4/1992 | Hardison | 211/105.3 X |

FOREIGN PATENT DOCUMENTS

| | | | |
|---|---|---|---|
| 402055100 | 2/1990 | Japan | 211/123 |

*Primary Examiner*—Derek J. Berger
*Assistant Examiner*—Donald J. Wallace
*Attorney, Agent, or Firm*—Morton J. Rosenberg; David I. Klein; Jun Y. Lee

[57] ABSTRACT

A laundry suspension rod includes an inner rod and first and second outer tubes. The inner rod includes an extension portion extending therefrom to which suit hangers or the like are removably attached. A C-shape restraining member is fixedly mounted to each of two ends of the inner rod a has a pair of parallel stripe formed on an inner peripheral wall thereof for slidably receiving the extension portion the inner rod therebetween. Each of the first and second outer tubes has a first end for telescopically receiving the inner rod an a second end. A stop member is fixedly mounted in the first end of each of the first and second outer tubes and has an open first end and a second end, a slot being defined in the second end of the stop member and having a cross-section the same as that of the inner rod, thereby allowing the inner rod to extend through the stop member and allowing the first and second outer tubes to slide along the inner rod. The outer tubes are movable between a fully extended position where the restraining member contacts with the associate stop member and a fully retracted position where the restraining member reaches the second end of the associate outer tube.

3 Claims, 6 Drawing Sheets

RETRACTABLE LAUNDRY SUSPENSION ROD

BACKGROUND OF THE INVENTION

1. Field of the Invention

The present invention relates to an improved laundry suspension rod to which clothes, such as shirts and socks etc. are attached or hanged so as to be exposed to the sun for drying purpose and, more particularly, to a laundry suspension rod which can be retracted for ease of carriage.

2. Description of Related Art

Conventionally, a laundry suspension rod used for outdoor drying purpose is generally a rod made of bamboo and a strength thereof deteriorates after prolonged exposure to sun and rain, thereby adversely affecting the life period thereof. A further problem for a bamboo dryer is the length which often results in inconvenient carriage for the purchasers bringing it home after purchase or entering an elevator.

The inventor, in view of the above disadvantages, has invented a laundry suspension rod which is shown in FIGS. 6 to 8 and includes a main tube 10 and two extension tubes 20 respectively and telescopically mounted to two ends of the main tube 10. The main tube 10 is substantially a hollow tube 11 having two restraining strips 12 extending longitudinally along an inner periphery thereof. Each extension tube 20 is substantially a semi-circular tube 21 having a transverse plate 22 extending along a lower edge thereof, a plurality of spaced holes 23 being defined in the transverse plate 22, a sleeve 24 being riveted to one end of the extension tube 20 and an end cap 25 being attached to said one end, and a through hole 26 being defined in the other end of the extension tube 20. A biasing means, such as an elastic element 27 is mounted in the extension tube 20 and has an engaging block 28 attached to a free end thereof such that, after assembly, the engaging block 28 may extend beyond the through hole 26.

As shown in FIGS. 7 and 8, in assembly, the elastic element 27 is mounted to one of the extension tube 20 with the engaging block 28 extending beyond the through hole 26, while the extension tube 20 without the elastic element 27 mounted therein is fixedly mounted to the main tube 10. The extension tubes 20 are respectively partially received in two ends of the main tube 10. For extending or retracting the extension tube 20 with the elastic element 27, the engaging block 28 is in a depressed position (see FIG. 7) to allow telescopical motion of the extension tube 20 in the main tube. When the extension tube 20 is extended to an outwardmost position, the engaging block 28 extends into the hole 13 in the main tube 10 to position the extension tube 20, as shown in FIG. 8. The engaging block 28 is depressed when retraction of the extension tube 20 is required for carriage purpose.

Although the above structure has mitigated the carriage problem of the laundry suspension rod, it still has some disadvantages, e.g., intensive labor is required to mount the elastic element 27 in the semi-circular tube 21 with the engaging block 28 received in the through hole 26. In addition, after a period of time, the elasticity of the elastic element 27 degrades and thus adversely affects engagement between the engaging block 28 and the through hole 26. Furthermore, it requires a relatively large force to overcome the frictional force between the inner surface of the main tube and an outer surface of the extension tube for extending or retracting the extension tube.

The present invention is intended to provide an improved design to mitigate and/or obviate the above problems.

SUMMARY OF THE INVENTION

A primary object of the present invention is to provide a laundry suspension rod comprising an inner rod and first and second outer tubes. The inner rod comprises two ends and an extension extending therefrom to which clothes hangers or the like are removably attached. A restraining member is fixedly mounted to each of the ends of the inner rod.

Each of the first and second outer tubes has a first end for telescopically receiving the inner rod and a second end. A stop member is fixedly mounted in the first end of each of the first and second outer tubes and has an open first end and a second end, a slot being defined in the second end of the stop member and having a cross-section the same as that of the inner rod, thereby allowing the inner rod to extend through the stop member and allowing the first and second outer tubes to slide along the inner rod.

By such an arrangement, the outer dryer is movable between a fully extended position where the restraining member contacts with the associated stop member and a fully retracted position where the restraining member reaches the second end of the associated outer tube.

Preferably, the restraining member comprises two parallel strips formed on an inner surface thereof and having a gap defined therebetween for slidably receiving the extension of the inner rod.

In accordance with one aspect of the invention, the inner rod comprises a hole defined in each of two ends thereof, and the restraining member includes a protrusion formed on an outer peripheral wall thereof for engaging with the associated hole in the inner rod.

In accordance with another aspect of the invention, each of the first and second outer tubes comprises a transverse through hole defined in a peripheral wall thereof and adjacent to the first end thereof, and the stop member comprises a pair of protrusions extending outwardly from an outer peripheral wall thereof for engaging with the transverse through hole. The stop member may comprise a flange on the second end thereof and two longitudinal slits defined in the peripheral wall thereof.

Other objects, advantages, and novel features of the invention will become more apparent from the following detailed description when taken in conjunction with the accompanying drawings.

DESCRIPTION OF THE PREFERRED EMBODIMENT

Figure 1:
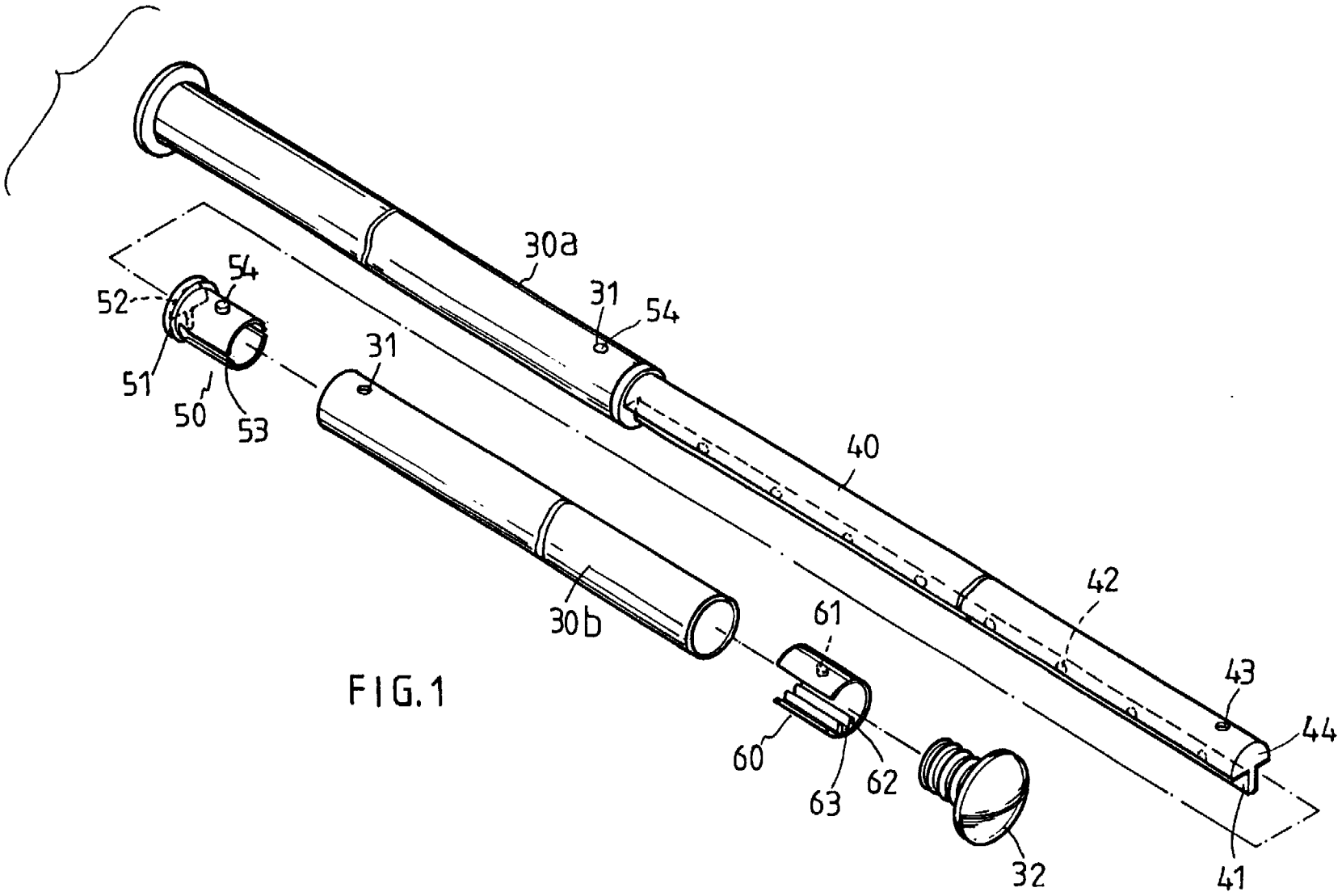
FIG. 1 is a perspective view, partly exploded, of a laundry suspension rod in accordance with the present invention.
Figure 2:
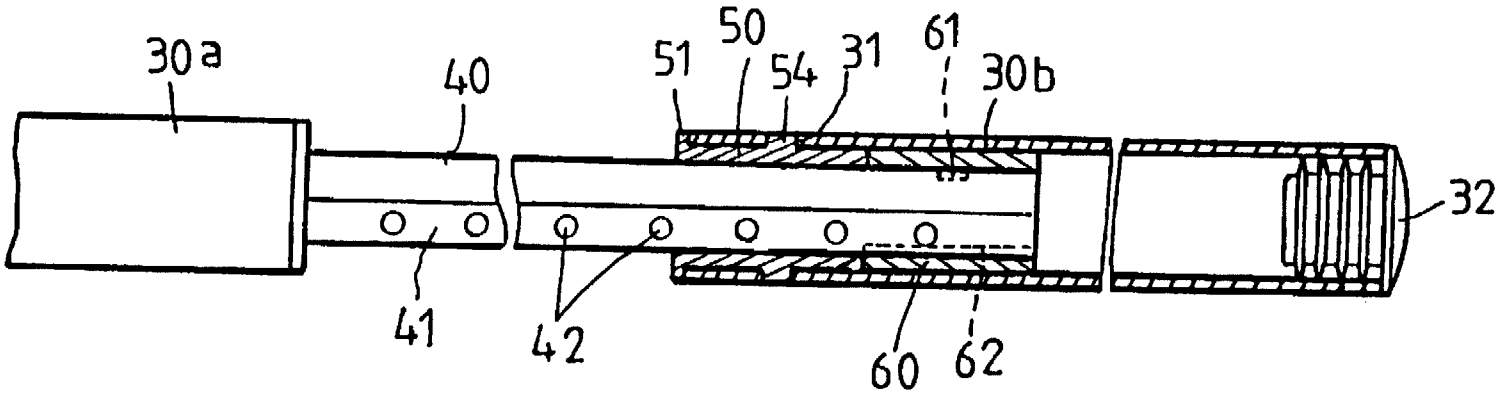
FIG. 2 is a front elevational view, partly cut-away and partly-sectioned, of the laundry suspension rod in an extended position.

Referring now to FIGS. 1 through 5 and initially to FIGS. 1 and 2, a laundry suspension rod in accordance with the present invention generally includes first and second outer tubes 30*a* and 30*b* and an inner rod 40.

The inner rod 40 includes a semi-circular elongate rod 44 having an extension 41 extending downwardly therefrom. A plurality of spaced holes 42 are defined in the extension 41 and a hole 43 is defined in each of two ends of the semi-circular elongate rod 44.

Each of the first and second outer tubes 30*a* and 30*b* includes a transverse through hole 31 in a peripheral wall thereof and adjacent to a first end thereof, and a stop member 50 is fixedly mounted in the first end of each outer tube 30*a*, 30*b*. As shown in FIG. 2, the stop member 50 includes first and second protrusions 54 extending outwardly from a peripheral wall thereof for engaging with the transverse through hole 31 in the first end of the associated outer tube 30*a*, 30*b*. Furthermore, the stop member 50 includes an open first end and a second end on which a flange 51 is formed. A slot 52 is defined in the second end and has a cross-section the same as that of the inner rod 40 such that the inner rod 40 may extend through the stop member 50. Preferably, the stop member 50 includes two longitudinal slits 53 defined in the peripheral wall to allow slight outward expansion of the stop member 50.

A substantially C-shaped restraining member 60 is fixedly mounted to an end of the inner rod 40. As shown in FIGS. 1 and 2, the restraining member 60 includes a pair of parallel strips 62 formed on an inner peripheral wall thereof and a protrusion 61 formed on an inner peripheral wall thereof, a gap 63 being defined between the strips 62.

In assembly, the stop member 50 is firstly fixedly mounted to the first end of each outer tube 30*a*, 30*b* with the protrusions 54 engaged in the transverse through hole 31. Then, the inner rod 40 is mounted and extended between the first and second outer tubes 30*a* and 30*b*, and two restraining members 60 are respectively mounted to two ends of the inner rod 40 with the protrusion 61 of each restraining member 60 engaged in the associated hole 43 and with the extension 41 of the inner rod 40 slidably received in the gap 63 defined between the parallel strips 62. Thereafter, two end caps 32 are removably mounted to the distal ends of the first and second outer tubes 30*a* and 30*b* engaged with the inner rod 40.

Figure 4:
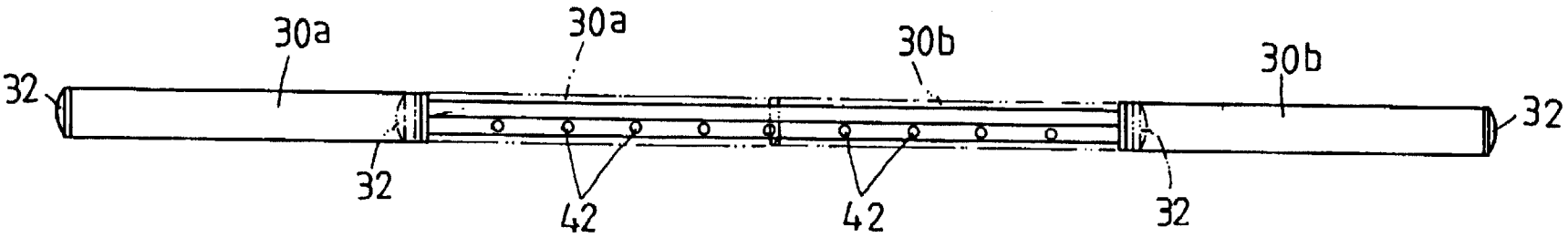
FIG. 4 is a schematic elevational view illustrating operation of the laundry suspension rod.
Figure 5:
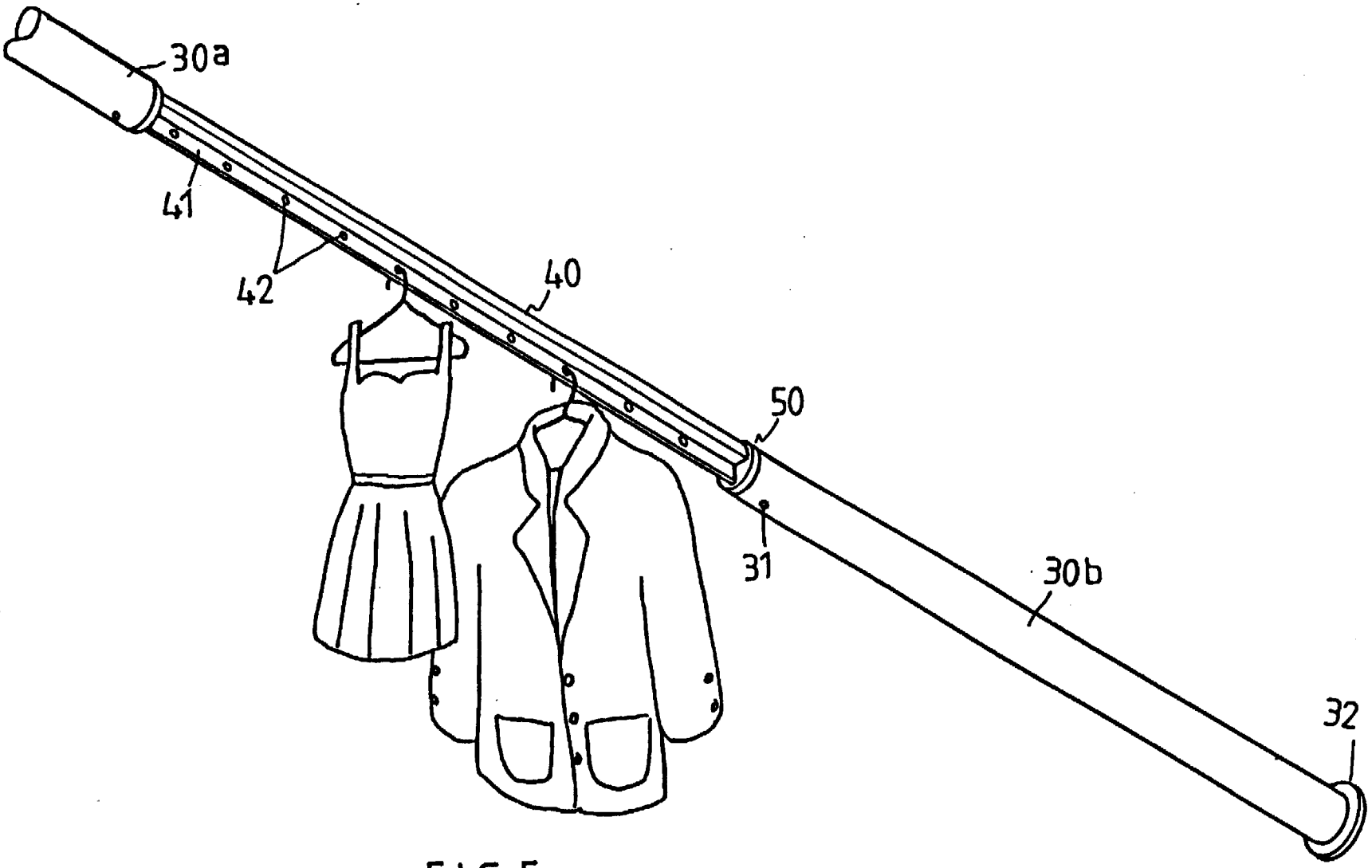
FIG. 5 is a schematic perspective view illustrating the use of the laundry suspension rod.
Figure 6:
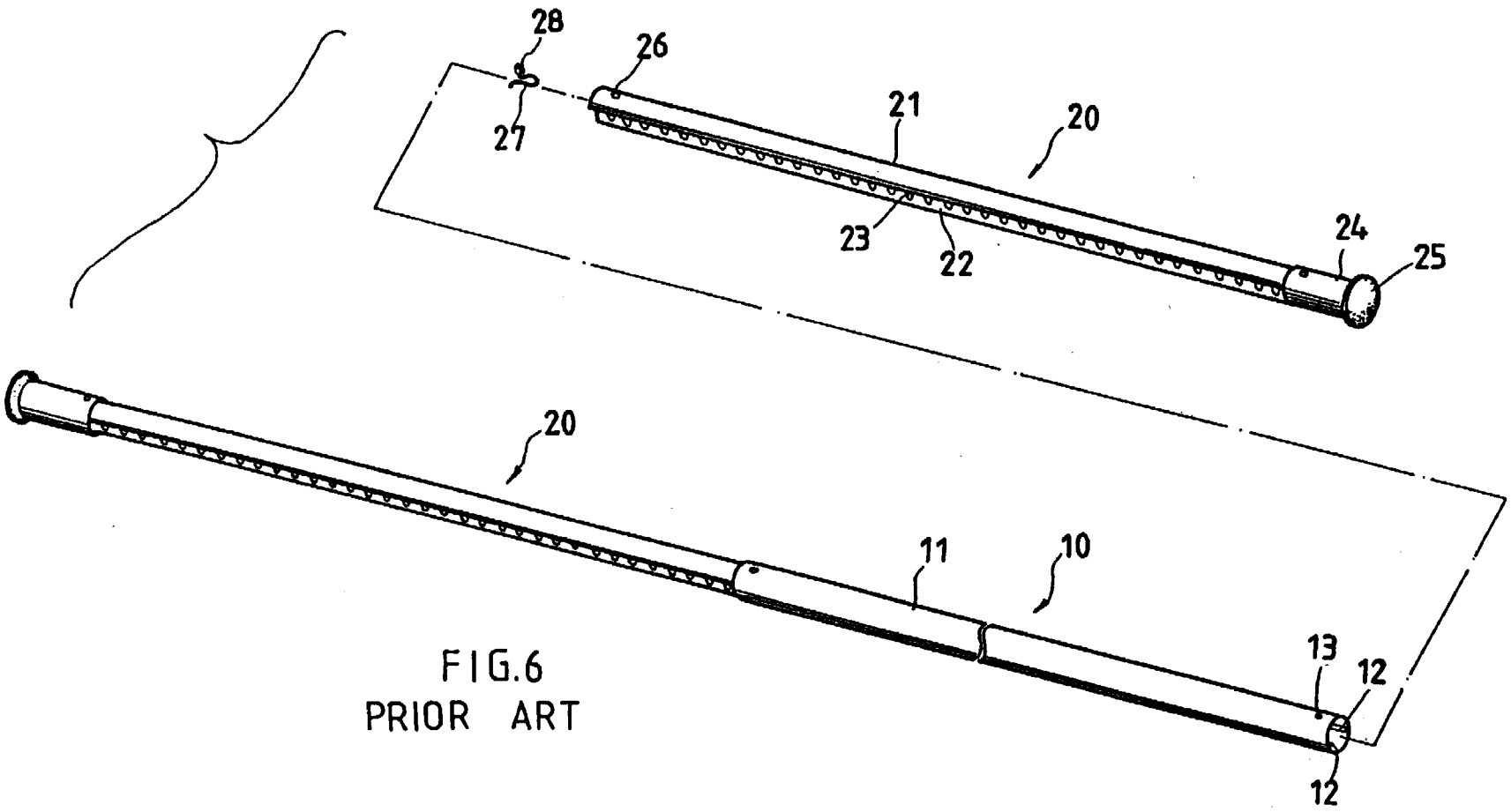
FIG.6 PRIOR ART
FIG. 6 is a perspective view, partly exploded, of a laundry suspension rod according to prior art.
Figure 7:
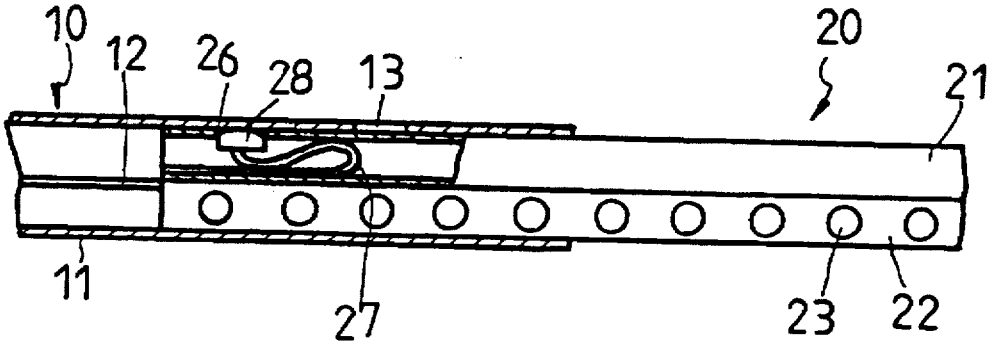
FIG. 7 PRIOR ART
FIGS. 7 and 8 are schematic fragmentary, partially sectional views illustrating operations of the prior art laundry suspension rod in FIG. 6.
Figure 8:
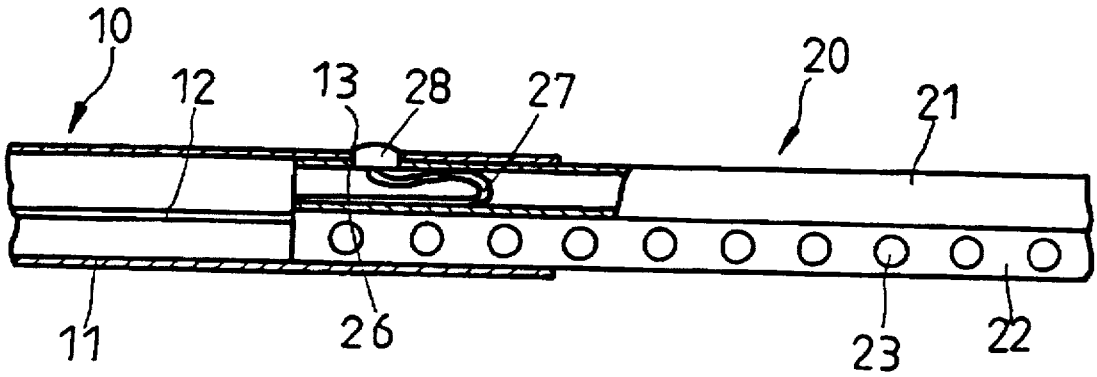
FIG. 8 PRIOR ART

In use, the two outer tubes 30*a* and 30*b* or the inner rod 40 and one of the outer tubes 30*a* and 30*b*, e.g., the second outer tube 30*b* may be manually pulled away from each other to lengthen the laundry suspension rod until the restraining member 60 in the second outer tube 30*b* contacts and thus is stopped by the stop member 50, i.e., the laundry suspension rod is in its fully extended position, as shown in FIG. 2 and the solid lines of FIG. 4. FIG. 5 illustrates the use of the laundry suspension rod in which clothes are hung on clothes hangers the hooks of which are passed through the holes 42 in the extension 41 of the laundry suspension rod.

Figure 3:
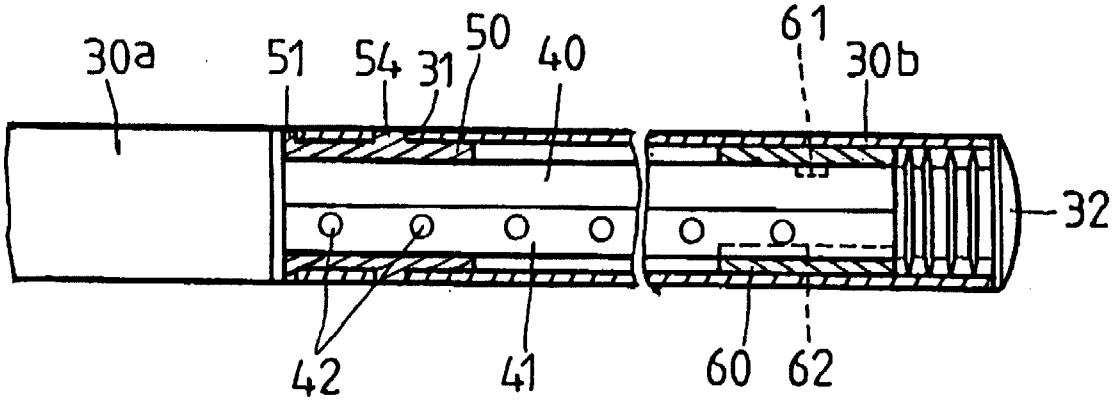
FIG. 3 is a front elevational view, partly cut-away and partly sectioned, of the laundry suspension rod in a retracted position.

For retracting or shortening the laundry suspension rod, the first and second outer tubes 30*a*, 30*b* is manually pushed toward each other until the second outer tube 30*b* reaches and is stopped by the end cap 32, as shown in FIG. 3 and the phantom lines in FIG. 4.

Although the invention has been explained in relation to its preferred embodiment, it is to be understood that many other possible modifications and variations can be made without departing from the spirit and scope of the invention as hereinafter claimed.

What is claimed is:

1. A laundry suspension rod comprising:

an inner rod define by (a) a semi-circular elongate rod portion having an arcuate upper surface and a planar bottom surface, and (b) an extension portion extending downwardly from the bottom surface of the semi-circular elongate rod portion, the upper surface of the semi-circular elongate rod portion having a hole formed in each of two opposing ends of the inner rod, the extension portion being adapted to maintain a plurality of clothes hangers in a fixed spaces relationship by means of a plurality of longitudinally spaced apertures formed through the extension portion;

a pair of C-shaped restraining members respectively secured to each of the ends of the inner rod, each of the pair of restraining members including a protrusion formed on an inner surface of a peripheral wall thereof or engagement within the hole in the respective end of the inner rod, the restraining member having a pair of parallel strips extending from the inner surface of the peripheral wall to form a recess therebetween for receiving an edge of the extension portion therein;

a first outer coupled to one end of the inner rod and a second outer tube coupled to the opposing end of the inner rod, each of the first and second outer tubes having a first end for telescopically receiving the inner rod and a second end, each of the first and second outer tubes having a pair of diametrically opposed through holes formed therein adjacent the first end thereof; and, a pair of stop members respectively secured within the first end of each of the first and second outer tubes, each of the pair of stop members having an open first end and a second end, the second end of each stop member having a slot matching the cross-section of the inner rod, thereby allowing the inner rod to extend through the stop member and allowing the first and second outer tubes to slide along the inner rod, each of the stop members having an outer peripheral wall and a pair of protrusions extending outwardly from opposing sides of the outer peripheral wall for engagement with the pair of through holes in a respective one of the first and second outer tubes, each of said first and second outer tubes movable between a fully extended position where a respective restraining member contacts with an associated stop member and a fully retracted position where the respective restraining member reaches the second end of the associated outer tube.

2. The laundry suspension rod as claimed in claim 1 wherein the second end of the stop member further comprises a flangs.

3. The laundry suspension rod as claimed in claim 1 wherein the stop member further comprises two longitudinal slits defined in the peripheral wall.

* * * * *